US008221083B2

(12) United States Patent
Alvanos et al.

(10) Patent No.: US 8,221,083 B2
(45) Date of Patent: Jul. 17, 2012

(54) ASYMMETRICAL ROTOR BLADE FIR-TREE ATTACHMENT

(75) Inventors: Ioannis Alvanos, West Springfield, MA (US); John J. OConnor, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 1128 days.

(21) Appl. No.: 12/103,673

(22) Filed: Apr. 15, 2008

(65) Prior Publication Data

US 2009/0257877 A1 Oct. 15, 2009

(51) Int. Cl.
*F01D 5/30* (2006.01)

(52) U.S. Cl. ..... 416/219 R; 416/248

(58) Field of Classification Search ..... 416/219 R, 416/248, 500

See application file for complete search history.

(56) References Cited

U.S. PATENT DOCUMENTS 3,045,968 A * 7/1962 Willis ..... 416/219 R
4,102,603 A 7/1978 Smith et al.
4,260,331 A 4/1981 Goodwin
4,265,595 A 5/1981 Bucy, Jr. et al.
4,326,835 A 4/1982 Wertz
4,343,594 A 8/1982 Perry
4,349,318 A 9/1982 Libertini et al.
4,418,605 A 12/1983 Tollefsen et al.
4,451,203 A * 5/1984 Langley ..... 416/215
4,453,890 A 6/1984 Brantley
4,507,052 A 3/1985 Thompson
4,523,890 A 6/1985 Thompson
4,583,914 A 4/1986 Craig et al.
4,596,501 A 6/1986 Wu
4,659,285 A 4/1987 Kalogeros et al.
4,863,352 A 9/1989 Hauser et al.
4,872,810 A 10/1989 Brown et al.
4,890,981 A 1/1990 Corsmeier et al.
4,895,490 A 1/1990 Kasperski
5,030,063 A 7/1991 Berger
5,039,278 A 8/1991 Wakeman et al.
5,067,876 A 11/1991 Moreman, III
5,134,843 A 8/1992 Wakeman
5,156,528 A * 10/1992 Bobo ..... 416/190
5,256,035 A 10/1993 Norris et al.
5,259,728 A 11/1993 Szpunar et al.
5,281,098 A 1/1994 Glynn et al.
5,282,720 A 2/1994 Szpunar
5,310,318 A 5/1994 Lammas et al.
5,368,444 A 11/1994 Anderson
5,443,366 A 8/1995 Knott et al.
5,518,369 A 5/1996 Modafferi
5,522,702 A 6/1996 Kemsley et al.
5,601,404 A 2/1997 Collins
5,622,475 A 4/1997 Hayner et al.
5,630,703 A 5/1997 Hendley et al.
5,662,458 A 9/1997 Owen
5,860,787 A 1/1999 Richards (Continued)

FOREIGN PATENT DOCUMENTS

EP 1616081 12/2007

*Primary Examiner* — Ninh H Nguyen
(74) *Attorney, Agent, or Firm* — Carlson Gaskey & Olds P.C.

(57) ABSTRACT

A rotor blade for a gas turbine engine includes an asymmetric attachment section received within a rotor disk rim with an asymmetric slot.

16 Claims, 6 Drawing Sheets

U.S. PATENT DOCUMENTS 5,888,049 A 3/1999 Broadhead et al.
5,913,660 A 6/1999 Knott
5,984,639 A 11/1999 Gekht et al.
6,010,304 A 1/2000 Moniz et al.
6,077,035 A 6/2000 Walters et al.
6,109,877 A 8/2000 Gekht et al.
6,176,677 B1 1/2001 Chevrefils et al.
6,413,041 B1 7/2002 Sedillo
6,457,942 B1 10/2002 Forrester
6,464,453 B2 10/2002 Toborg et al.
6,481,971 B1 11/2002 Forrester
6,533,550 B1 3/2003 Mills
6,578,351 B1 6/2003 Modafferi
6,733,233 B2 5/2004 Jasklowski et al.
6,735,956 B2 5/2004 Romani
6,837,686 B2 1/2005 Di Paola et al.
6,884,028 B2 4/2005 Brauer et al.
6,932,575 B2 8/2005 Surace et al.
6,971,852 B2 * 12/2005 Phipps et al. ..... 416/1
6,974,306 B2 12/2005 Djeridane et al.
6,976,826 B2 12/2005 Roy et al.
7,001,150 B2 2/2006 Fett et al.
7,153,102 B2 12/2006 Stone
7,156,621 B2 1/2007 Stone
7,189,055 B2 3/2007 Marini et al.
7,189,056 B2 3/2007 Girgis et al.
7,192,245 B2 3/2007 Djeridane et al.
7,238,008 B2 7/2007 Bobo et al.
7,244,104 B2 7/2007 Girgis et al.
7,244,105 B2 7/2007 Moeller
7,252,481 B2 8/2007 Stone
7,284,958 B2 10/2007 Dundas et al.
7,287,961 B2 10/2007 Broadhead et al.
7,296,969 B2 11/2007 Raes et al.

* cited by examiner

ASYMMETRICAL ROTOR BLADE FIR-TREE ATTACHMENT

BACKGROUND

The present invention relates to a gas turbine engine, and more particularly to a rotor blade attachment thereof.

Gas turbine engines often include a multiple of rotor assemblies within a fan, compressor and turbine section. Each rotor assembly has a multitude of blades attached about a circumference of a rotor disk. Each of the blades is spaced a distance apart from adjacent blades to accommodate movement and expansion during operation. Each blade includes a root section that attaches to the rotor disk, a platform section, and an airfoil section that extends radially outwardly from the platform section.

Gas turbine engine rotor blades are typically attached in a rotor disk rim through a fir-tree-type root attachment section. The blades are then locked into place with bolts, peening, locking wires, pins, keys, plates, or other locks. The blades need not fit too tightly in the rotor disk due to the centrifugal forces during engine operation. Some blade movement reduces the vibrational stresses produced by high-velocity airstreams between the blades.

Referring to FIG. 1A, current rotor blade fir-tree-type root design attachments are symmetrical in shape and may vary from one lobe to four or more lobe tooth attachment designs. Although effective, this symmetry results in a reduced cross-sectional area between each blade which may limit Low Cycle Fatigue (LCF) and shear strength (P/A) (FIG. 1B) capability.

SUMMARY

A rotor blade for a gas turbine engine according to an exemplary aspect of the present invention includes: an asymmetric attachment section.

A rotor disk for a gas turbine engine according to an exemplary aspect of the present invention includes: a hub; a rim; and a web which extends between said hub and said rim, said rim defines a multiple of asymmetric slots.

A rotor blade for a gas turbine engine according to an exemplary aspect of the present invention includes: an asymmetric attachment section defines a multiple of first lobes and a multiple of first pockets on a first side and a multiple of second lobes and a multiple of second pockets on a second side, at least one of the multiple of first lobes located generally opposite a second pocket and at least one of the multiple of first pockets located generally opposite a second lobe.

BRIEF DESCRIPTION OF THE DRAWINGS

The various features and advantages of this invention will become apparent to those skilled in the art from the following detailed description of the disclosed non-limiting embodiment. The drawings that accompany the detailed description can be briefly described as follows.

DETAILED DESCRIPTION OF THE EXEMPLARY EMBODIMENTS

Figure 1B:
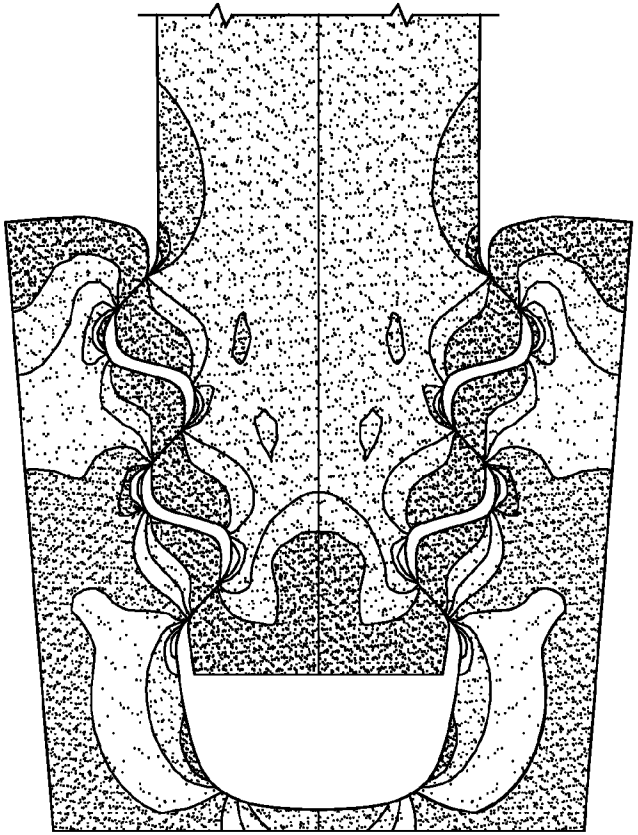
FIG.1B Prior Art
FIG. 1B is an expanded front sectional view of a PRIOR ART rotor disk illustrating the stresses on the symmetric attachment between one blade and the rotor disk.
Figure 1A:
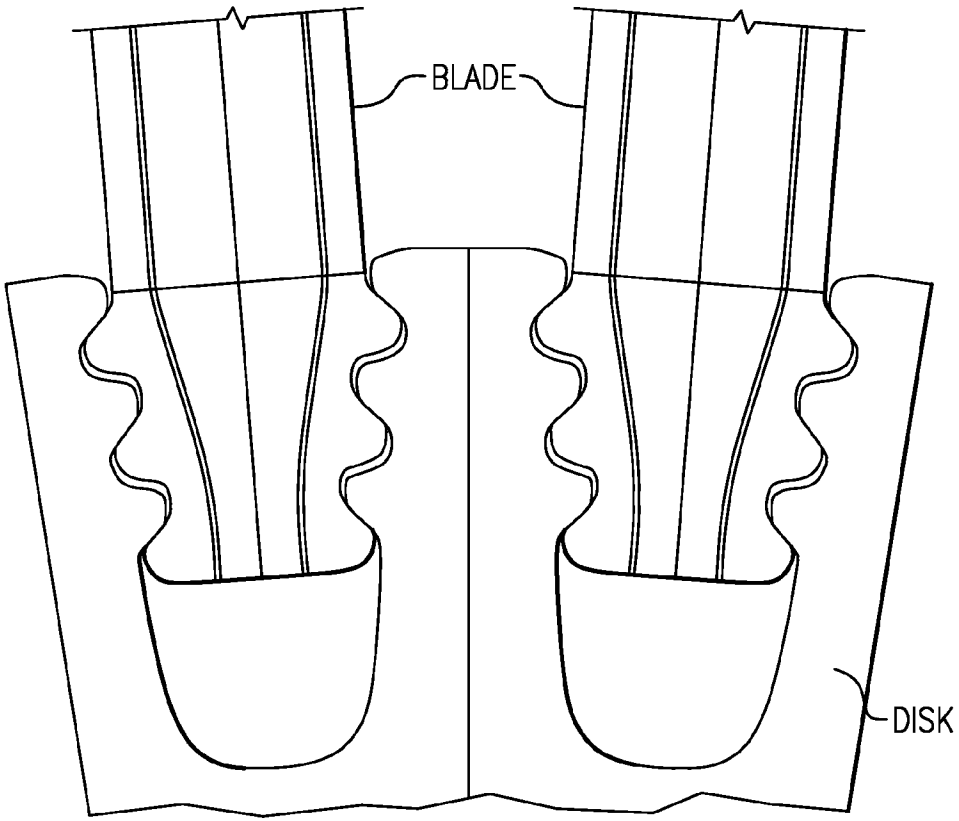
FIG.1A Prior Art
FIG. 1A is an expanded front sectional view of a PRIOR ART rotor disk illustrating a symmetric attachment between two blades and the rotor disk.
Figure 2:
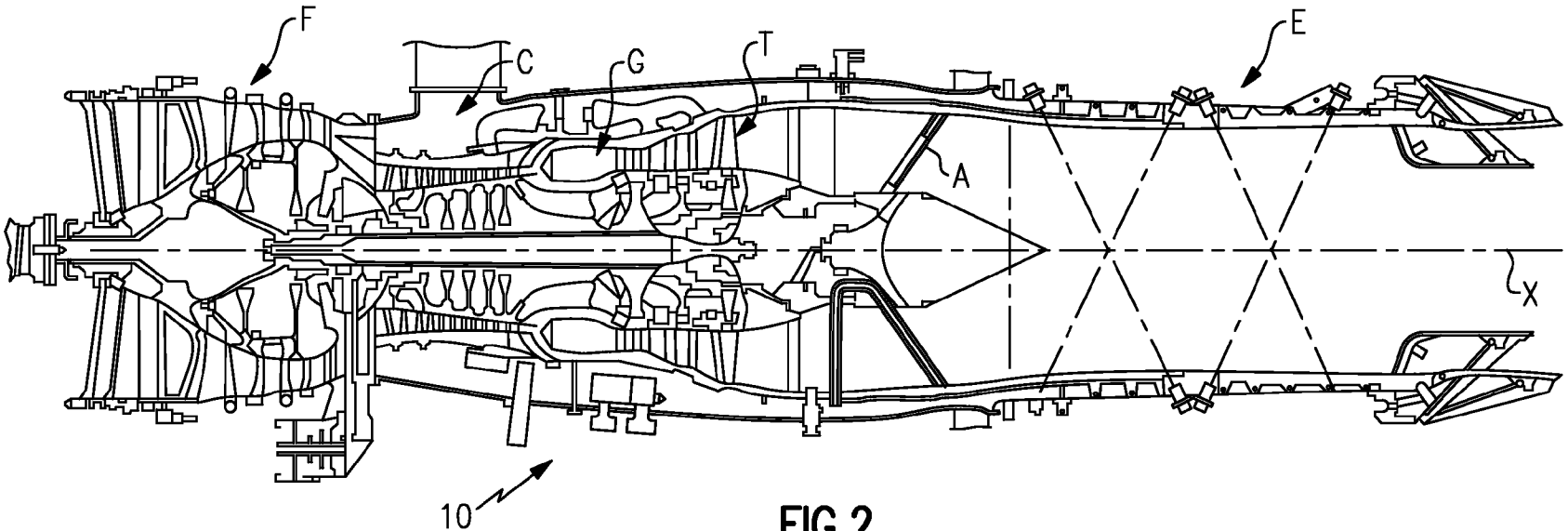
FIG. 2 is a schematic illustration of a gas turbine engine.

FIG. 2 schematically illustrates a gas turbine engine 10 which generally includes a fan section F, a compressor section C, a combustor section G, a turbine section T, an augmentor section A, and an exhaust duct assembly E. The compressor section C, combustor section G, and turbine section T are generally referred to as the core engine. An engine longitudinal axis X is centrally disposed and extends longitudinally through these sections. Although a particular engine configuration is illustrated and described in the disclosed embodiment, other engines will also benefit herefrom.

Figure 3:
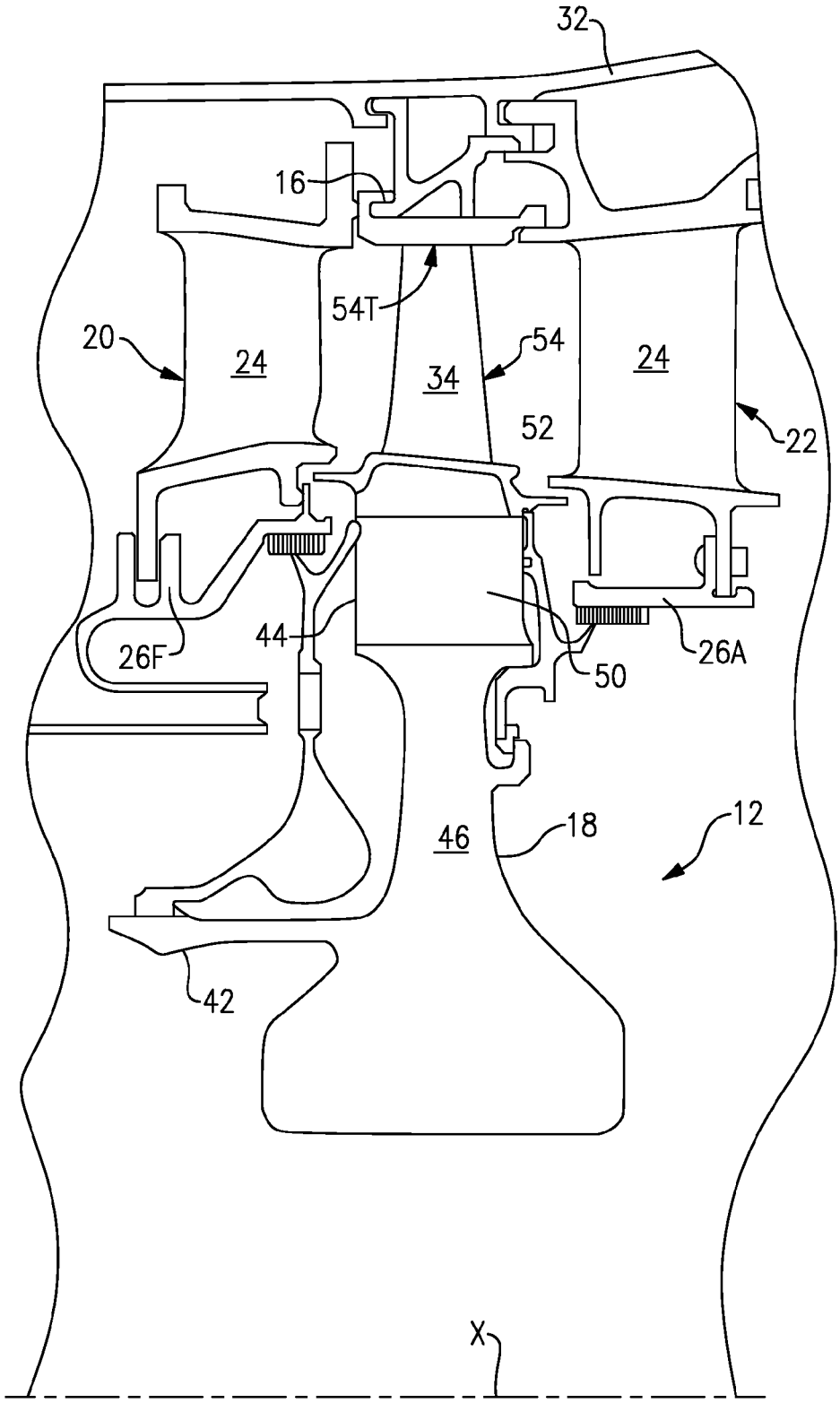
FIG. 3 is a general sectional diagrammatic view of a gas turbine engine HPT section of the engine of FIG. 2.

FIG. 3 schematically illustrates a High Pressure Turbine (HPT) section of the gas turbine engine 10 having a turbine disk assembly 12 within the turbine section T disposed along the engine longitudinal axis X. It should be understood that a multiple of disks may be contained within each engine section and that although the HPT section is illustrated and described in the disclosed embodiment, other sections which have other blades such as fan blades, low pressure turbine blades, high pressure turbine blades, high pressure compressor blades and low pressure compressor blades will also benefit herefrom.

The HPT section includes a blade outer air seal assembly 16 with a rotor assembly 18 disposed between a forward stationary vane assembly 20 and an aft stationary vane assembly 22. Each vane assembly 20, 22 includes a plurality of vanes 24 circumferentially disposed around an inner vane support 26F, 26A.

Figure 4:
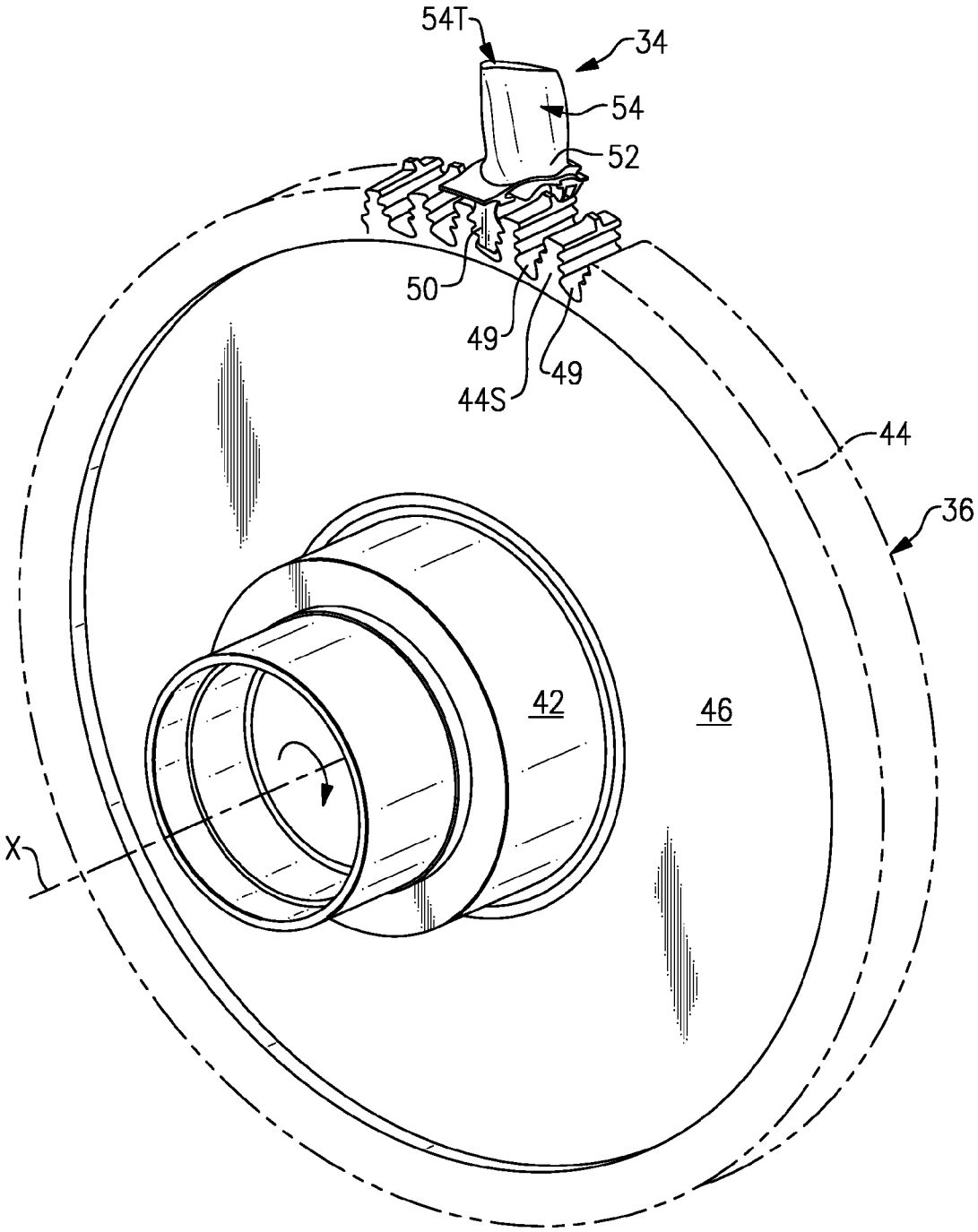
FIG. 4 is an expanded perspective view of the blade mounted to a rotor disk.

The rotor assembly 18 includes a plurality of blades 34 circumferentially disposed around a rotor disk 36 (FIG. 4). The rotor disk 36 generally includes a hub 42, a rim 44, and a web 46 which extends therebetween. Each blade 34 generally includes an asymmetric attachment section 50, a platform section 52 and an airfoil section 54 along a longitudinal axis X. Each of the blades 34 is received within the rim 44 of the rotor disk 36 such that the asymmetric attachment section 50 is engaged therewith. The outer edge of each airfoil section 54 is a blade tip 54T which is adjacent the blade outer air seal assembly 16.

Figure 5A:
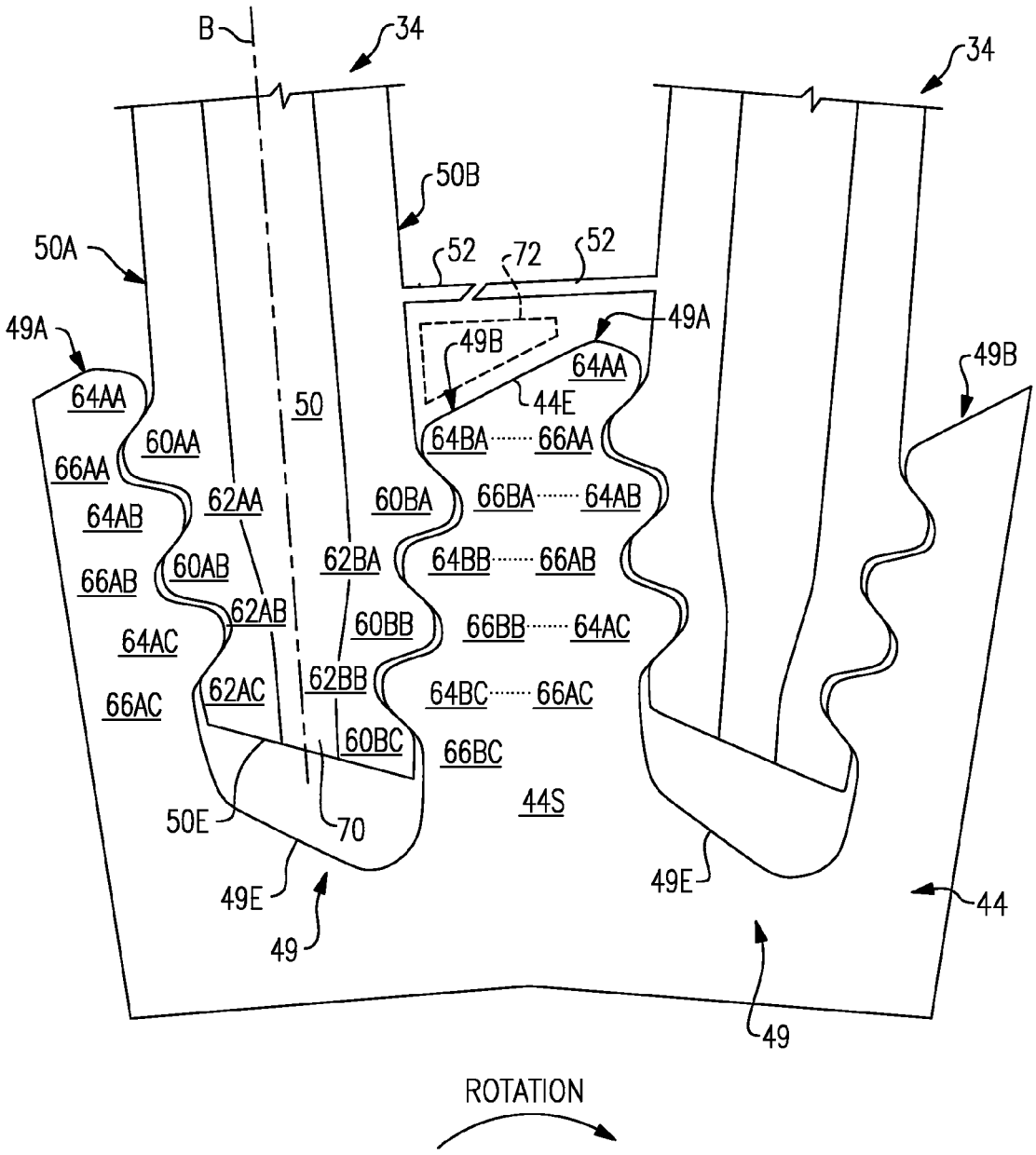
FIG. 5A is an expanded front sectional view of the rotor disk illustrating an asymmetric attachment between two blades and the rotor disk.

Referring to FIG. 5A, the asymmetric attachment section 50 defines a first side 50A and a second side 50B. In one non-limiting embodiment, the first side 50A is the pressure side and the second side 50B is a suction side relative the rotational direction of the rotor disk 36. The first side 50A includes a multiple of lobes 60AA, 60AB, 60AC and a multiple of pockets 62AA, 62AB. The second side 50B includes a multiple of lobes 60BA, 60BB, 60BC and a multiple of pockets 62BA, 62BB. The multiple of lobes 60AA, 60AB, 60AC and the multiple of pockets 62AA, 62AB on the first side 50 are offset from the respective multiple of lobes 60BA, 60BB, 60BC and the multiple of pockets 62BA, 62BB on the second side 50B. The pocket 62AA is across from the lobe 60BA; the lobe 60AB is across from the lobe 62BA; the pocket 62AB is across from the lobe 60BB; and the lobe 60AC is across from the pocket 62BB relative to blade axis B. The asymmetrical fir-tree type attachment thereby provides tooth attachment lobes that are radially offset relative to the opposite side of the accepting set. The asymmetrical fir-tree type attachment may be manufactured through EDM, broaching, or grinding.

The rim 44 defines an asymmetrical slot 49 to receive the asymmetric attachment section 50 of the respective blade 34. Each asymmetrical slot 49 defines a first side 49A and a second side 49B. The first side 49A includes a multiple of lobes 64AA, 64AB, 64AC and a multiple of pockets 66AA, 66AB, 66AC. The second side 49B includes a multiple of lobes 64BA, 64BB, 64BC and a multiple of pockets 66BA, 66BB, 66BC. The pocket 66AA is across from the lobe 64BA; the lobe 64AB is across from the pocket 66BA; the pocket 66AB is across from the lobe 64BB; the lobe 64AC is across from the pocket 66BB; and the pocket 66AC is across from the lobe 64BC relative to blade axis B.

A rim section 44S is defined between each of two asymmetric slots 49. The rim section 44S includes the lobe 64BA across from the pocket 66AA; the pocket 66BA across from the lobe 64AB; the lobe 64BB across from the pocket 66AB; the pocket 66BB across from the lobe 64AC; and the lobe 64BC across from the pocket 66AC.

This asymmetrical shape of the asymmetric attachment section 50 and the asymmetrical slot 49 may be formed through EDM, grinding, or broaching, which facilitates the flexibility to shape the fir-tree in a manner that can vary symmetry. The variation in symmetry increases the cross-sectional area of the rim section 44S between each blade asymmetrical slot 49 and the asymmetric attachment section 50 by offsetting the lobes.

Figure 5B:
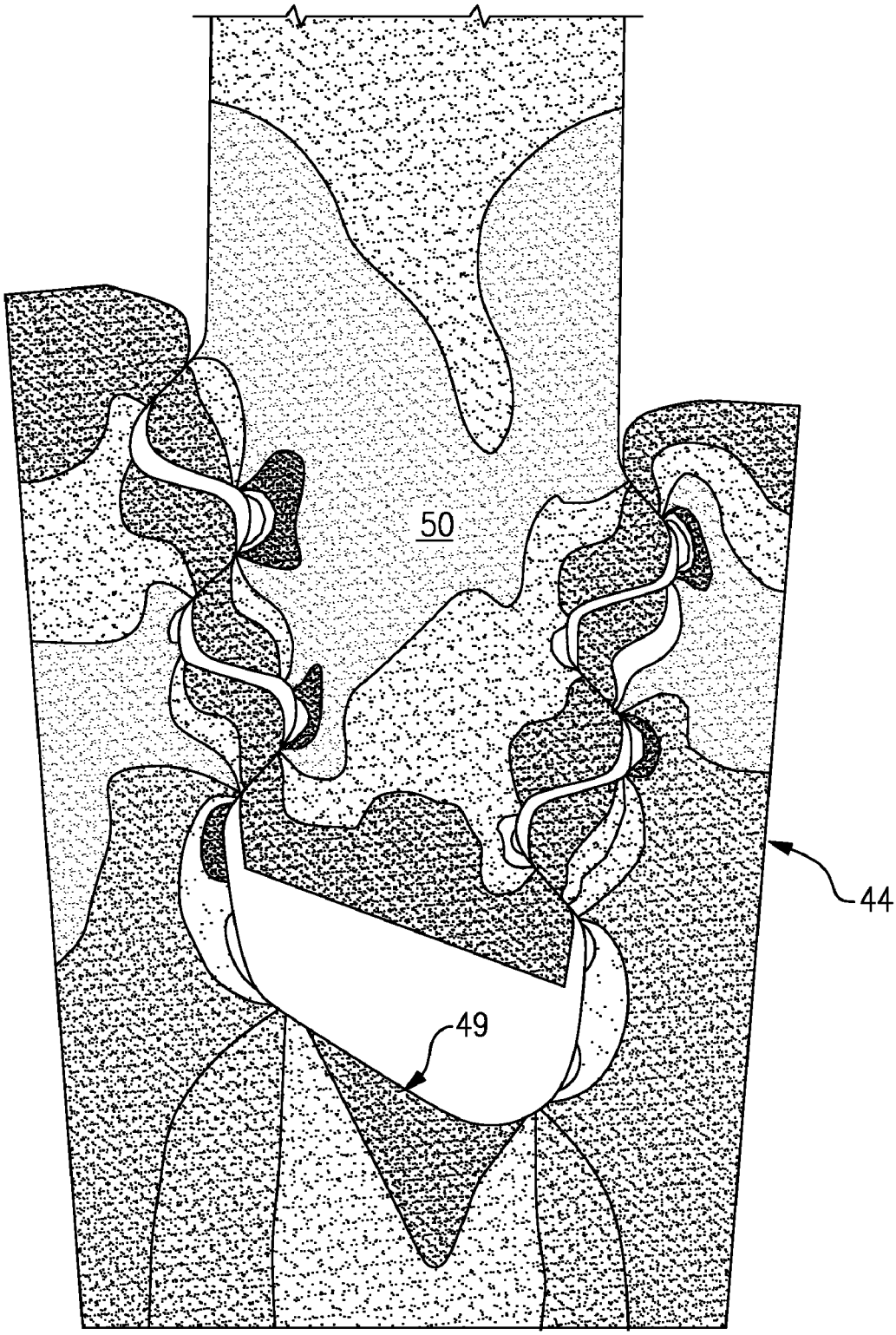
FIG. 5B is an expanded front sectional view of a rotor disk illustrating the stresses on the asymmetric attachment between one blade and the rotor disk.

The asymmetrical interface reduces shear stress and increase the overall capability of the blade 34 and the rotor disk 36. The reduced stress (FIG. 5B) allows for reduced weight or an increase in performance by allowing the rotor system to increase in operational speed (RPM—revolutions per minute). Although the asymmetrical interface of the asymmetric attachment section 50 and the asymmetrical slot 49 may generate a slight moment, the moment is readily compensated for by slight changes to the airfoil section 54.

An angled distal end 50E (FIG. 5A) of the asymmetric attachment section 50 relative to an angled distal end 49E of the asymmetric slot 49 provides a larger inlet area for cooling flow into an airflow cooling channel 70 of the blade 34.

A shorter neck length below the platform section 53 is also facilitated by the asymmetric attachment section 50 as underplatform section hardware 72 (illustrated schematically) such as a damper and featherseal may be located adjacent an angled outer diameter 44E of the rims section 44S. That is, the underplatform section hardware 72 is located within the triangular area defined by the angled outer diameter 44E and the platform section 52.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A rotor blade for a gas turbine engine comprising:

an asymmetric attachment section, which locates a lobe generally opposite a pocket wherein the radially outermost lobe of the attachment section includes a surface facing away from an axis of rotation of the gas turbine engine, the surface interfacing directly with a radially directed surface of a blade.

2. The rotor blade as recited in claim 1, wherein said asymmetric attachment section extends from a platform section and an airfoil section extends from said platform section opposite said asymmetric attachment.

3. The rotor blade as recited in claim 1, wherein said asymmetric attachment section defines an angled distal end.

4. The rotor blade as recited in claim 3, wherein the angled distal end is aligned with an angled distal end of an asymmetric slot that is configured to receive the asymmetric attachment section.

5. The rotor blade as recited in claim 1, wherein said asymmetric attachment section defines a multiple of lobes and a multiple of pockets, each of said multiple of lobes located on a first side of said asymmetric attachment section generally opposite a pocket of said multiple of pockets on a second side of said asymmetric attachment section.

6. The rotor blade as recited in claim 1, wherein said asymmetric attachment section defines a multiple of lobes and a multiple of pockets, each of said multiple of lobes located on a second side of said asymmetric attachment section generally opposite a pocket of said multiple of pockets on a first side of said asymmetric attachment section.

7. The rotor blade as recited in claim 1, wherein said asymmetric attachment section defines a multiple of lobes and a multiple of pockets, each of said multiple of lobes located on a first side of said asymmetric attachment section generally opposite a pocket of said multiple of pockets on a second side of said asymmetric attachment section.

8. The rotor blade as recited in claim 1, wherein the circumferentially outermost portion of the asymmetric attachment section is radially spaced from a platform section of a blade having the asymmetric attachment section.

9. A rotor disk for a gas turbine engine comprising:

a hub;

a rim; and a web which extends between said hub and said rim, said rim defines a multiple of asymmetric slots, each of said multiple of slots comprises a lobe generally opposite a pocket, wherein each of two of said multiple of asymmetric slots defines a rim section therebetween, and wherein said rim section defines an angled outer diameter.

10. The rotor disk as recited in claim 9, wherein each of said multiple of asymmetric slots defines an angled distal end.

11. The rotor disk as recited in claim 9, wherein each of said multiple of asymmetric slots defines a multiple of lobes and a multiple of pockets, each of said multiple of lobes located on a first side of each of said multiple of asymmetric slots generally opposite a pocket of said multiple of pockets on a second side of each of said multiple of asymmetric slots.

12. The rotor disk as recited in claim 9, wherein each of said multiple of asymmetric slots defines a multiple of lobes and a multiple of pockets, each of said multiple of lobes located on a second side of each of said multiple of asymmetric slots generally opposite a pocket of said multiple of pockets on a first side of each of said multiple of asymmetric slots.

13. The rotor disk as recited in claim 9, wherein each of said multiple of asymmetric slots defines a multiple of lobes and a multiple of pockets, each of said multiple of lobes located on a first side of each of said multiple of asymmetric slots generally opposite a pocket of said multiple of pockets on a second side of each of said multiple of asymmetric slots, each of said multiple of lobes located on said second side of each of said multiple of asymmetric slots generally opposite a pocket of said multiple of pockets on said first side of each of said multiple of asymmetric slots.

14. A rotor blade for a gas turbine engine comprising:

an asymmetric attachment section defines a multiple of first lobes and a multiple of first pockets on a first side and a multiple of second lobes and a multiple of second pockets on a second side, at least one of said multiple of first lobes located generally opposite a second pocket and at least one of said multiple of first pockets located generally opposite a second lobe; and a radially outermost lobe of the asymmetric attachment section includes a surface facing radially away from a rotational axis of the gas turbine engine.

15. The rotor blade as recited in claim 14, wherein said asymmetric attachment section extends from a platform section and an airfoil section extends from said platform section opposite said symmetric attachment.

16. The rotor blade as recited in claim 14, wherein the surface facing away from the rotational axis is radially closer to the rotational axis than an outermost diameter of said rim.

* * * * *